US008290402B2

(12) United States Patent
Hazeyama

(10) Patent No.: US 8,290,402 B2
(45) Date of Patent: Oct. 16, 2012

(54) IMAGE FORMING DEVICE EMPLOYING CHARGER FOR CHARGING PHOTOSENSITIVE MEMBER

(75) Inventor: Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 434 days.

(21) Appl. No.: 12/725,831

(22) Filed: Mar. 17, 2010

(65) Prior Publication Data

US 2010/0239315 A1 Sep. 23, 2010

(30) Foreign Application Priority Data

Mar. 23, 2009 (JP) ..... 2009-069806

(51) Int. Cl.
*G03G 15/02* (2006.01)

(52) U.S. Cl. ..... 399/171; 399/172

(58) Field of Classification Search ..... 399/170–172; 250/324–326

See application file for complete search history.

(56) References Cited

U.S. PATENT DOCUMENTS

| | | | | |
|---|---|---|---|---|
| 3,603,789 | A * | 9/1971 | Da Prato | 250/325 |
| 3,811,048 | A * | 5/1974 | Matsumoto et al. | 250/326 |
| 5,781,829 | A * | 7/1998 | Wong et al. | 399/172 |
| 7,356,286 | B2 | 4/2008 | Itabashi et al. | |
| 2005/0074254 | A1 | 4/2005 | Maeda | |
| 2006/0034635 | A1 | 2/2006 | Itabashi et al. | |

FOREIGN PATENT DOCUMENTS

| | | | |
|---|---|---|---|
| JP | 63-38154 | A | 3/1988 |
| JP | 63-038154 | U | 3/1988 |
| JP | 1-88952 | U | 6/1989 |
| JP | 3-33437 | U | 4/1991 |
| JP | 3-164771 | A | 7/1991 |
| JP | 2002-116606 | | 4/2002 |
| JP | 2003345110 | | 12/2003 |
| JP | 2006-098746 | A | 4/2006 |

OTHER PUBLICATIONS

JP Office Action dtd Feb. 1, 2011, JP Appln. 2009-069806, English Translation.

* cited by examiner

*Primary Examiner* — William J Royer
(74) *Attorney, Agent, or Firm* — Banner & Witcoff, Ltd.

(57) ABSTRACT

An image forming device includes a photosensitive member and a charger. The charger includes a wire electrode, a grid electrode and a shield electrode. The shield electrode including first and second ends facing the photosensitive member, the first end being disposed upstream of the second end in a moving direction of the photosensitive member, a shortest distance defined between a plurality of sections of the shield electrode and the wire electrode and being a length of a straight line that connects the wire electrode and an imaginary plane, the shortest distances between the sections of the shield electrode and the wire electrode being equal to one another, a first distance between the first end and a reference plane being smaller than a second distance between the second end and the reference plane, the reference plane including the wire electrode and extending perpendicularly to the photosensitive member.

18 Claims, 10 Drawing Sheets

IMAGE FORMING DEVICE EMPLOYING CHARGER FOR CHARGING PHOTOSENSITIVE MEMBER

CROSS REFERENCE TO RELATED APPLICATION

This application claims priority from Japanese Patent Application No. 2009-069806 filed Mar. 23, 2009. The entire content of the priority application is incorporated herein by reference.

TECHNICAL FIELD

The present invention relates to a charger that charges a photosensitive member in an electrophotographic image forming device.

BACKGROUND

A conventional processing device within an electrophotographic image forming apparatus is provided with a charger for charging a photosensitive member. Such a conventional charger includes a wire electrode to which a high voltage is applied, a grid electrode disposed between the wire electrode and the photosensitive member, and a shield electrode covering the wire electrode from a side opposite to the grid electrode.

In recent years, there has been a demand for the photosensitive member to move fast relative to the charger for the purpose of speeding up image formation. As a consequence, the charger is also required to have an improved charging capability.

To this effect, there is proposed a charger in which the wire electrode is disposed at a position upstream of the center within the shield electrode in a direction in which the surface of the photosensitive member moves in order for the surface of the photosensitive member to be charged in a prompt manner.

SUMMARY

However, each wall section constituting the shield electrode should preferably be arranged to have a distance from the wire electrode substantially the same as each other. When, as in the above-described charger, only one of the wall sections located upstream in the moving direction of the photosensitive member is disposed closer to the wire electrode, there arises a fear that corona discharge may not be generated stably, possibly leading to a spark discharge.

In view of the foregoing, it is an object of the present invention to provide a charger capable of stably generating corona discharge with enhanced charging capability.

In order to attain the above and other objects, there is provided an image forming device that includes a photosensitive member and a charger. The photosensitive member has a photosensitive surface that moves in a moving direction and that is configured to form a latent electrostatic image thereon. The charger opposes the photosensitive surface and is configured to charge the photosensitive surface. The charger includes a wire electrode, a grid electrode and a shield electrode. The wire electrode is configured to be applied with a voltage for charging the photosensitive surface. The grid electrode is disposed at a location between the wire electrode and the photosensitive surface. The shield electrode is arranged to partly surround the wire electrode, the shield electrode having a plurality of sections, the shield electrode having an opening at a side the same as the grid electrode with respect to the wire electrode, the shield electrode including a first end and a second end each facing the photosensitive surface, the first end being disposed upstream relative to the second end in the moving direction, the opening being defined between the first end and the second end, a shortest distance being defined between each of the plurality of sections of the shield electrode and the wire electrode and being a length of a straight line that connects the wire electrode and an imaginary plane extending along the each section and that is perpendicular to the imaginary plane, the shortest distances between the respective sections of the shield electrode and the wire electrode being equal to one another, a first distance defined between the first end and a reference plane being smaller than a second distance defined between the second end and the reference plane, the reference plane including the wire electrode and extending perpendicularly to the photosensitive surface.

According to another aspect of the present invention, there is provided a drum unit that is detachably mounted in an image forming device. The drum unit includes a photosensitive member and a charger. The photosensitive member has a photosensitive surface that moves in a moving direction and that is configured to form a latent electrostatic image thereon. The charger opposes the photosensitive surface and is configured to charge the photosensitive surface. The charger includes a wire electrode, a grid electrode and a shield electrode. The wire electrode is configured to be applied with a voltage for charging the photosensitive surface. The grid electrode is disposed at a location between the wire electrode and the photosensitive surface. The shield electrode is arranged to partly surround the wire electrode, the shield electrode having a plurality of sections, the shield electrode having an opening at a side the same as the grid electrode with respect to the wire electrode, the shield electrode including a first end and a second end each facing the photosensitive surface, the first end being disposed upstream relative to the second end in the moving direction, the opening being defined between the first end and the second end, a shortest distance being defined between each of the plurality of sections of the shield electrode and the wire electrode and being a length of a straight line that connects the wire electrode and an imaginary plane extending along the each section and that is perpendicular to the imaginary plane, the shortest distances between the respective sections of the shield electrode and the wire electrode being equal to one another, a first distance defined between the first end and a reference plane being smaller than a second distance defined between the second end and the reference plane, the reference plane including the wire electrode and extending perpendicularly to the photosensitive surface.

According to still another aspect of the present invention, there is provided a charger disposed in an image forming device. The image forming device is provided with a photosensitive member having a photosensitive surface that moves in a moving direction and that is configured to form a latent electrostatic image thereon. The charger opposes the photosensitive surface and is configured to charge the photosensitive surface. The charger includes a wire electrode, a grid electrode and a shield electrode. The wire electrode is configured to be applied with a voltage for charging the photosensitive surface. The grid electrode is disposed at a location between the wire electrode and the photosensitive surface. The shield electrode is arranged to partly surround the wire electrode, the shield electrode having a plurality of sections, the shield electrode having an opening at a side the same as the grid electrode with respect to the wire electrode, the shield electrode including a first end and a second end each facing the photosensitive surface, the first end being disposed upstream relative to the second end in the moving direction, the opening being defined between the first end and the second end, a shortest distance being defined between each of the plurality of sections of the shield electrode and the wire electrode and being a length of a straight line that connects the wire electrode and an imaginary plane extending along the each section and that is perpendicular to the imaginary plane, the shortest distances between the respective sections of the shield electrode and the wire electrode being equal to one another, a first distance defined between the first end and a reference plane being smaller than a second distance defined between the second end and the reference plane, the reference plane including the wire electrode and extending perpendicularly to the photosensitive surface.

DETAILED DESCRIPTION

Figure 1:
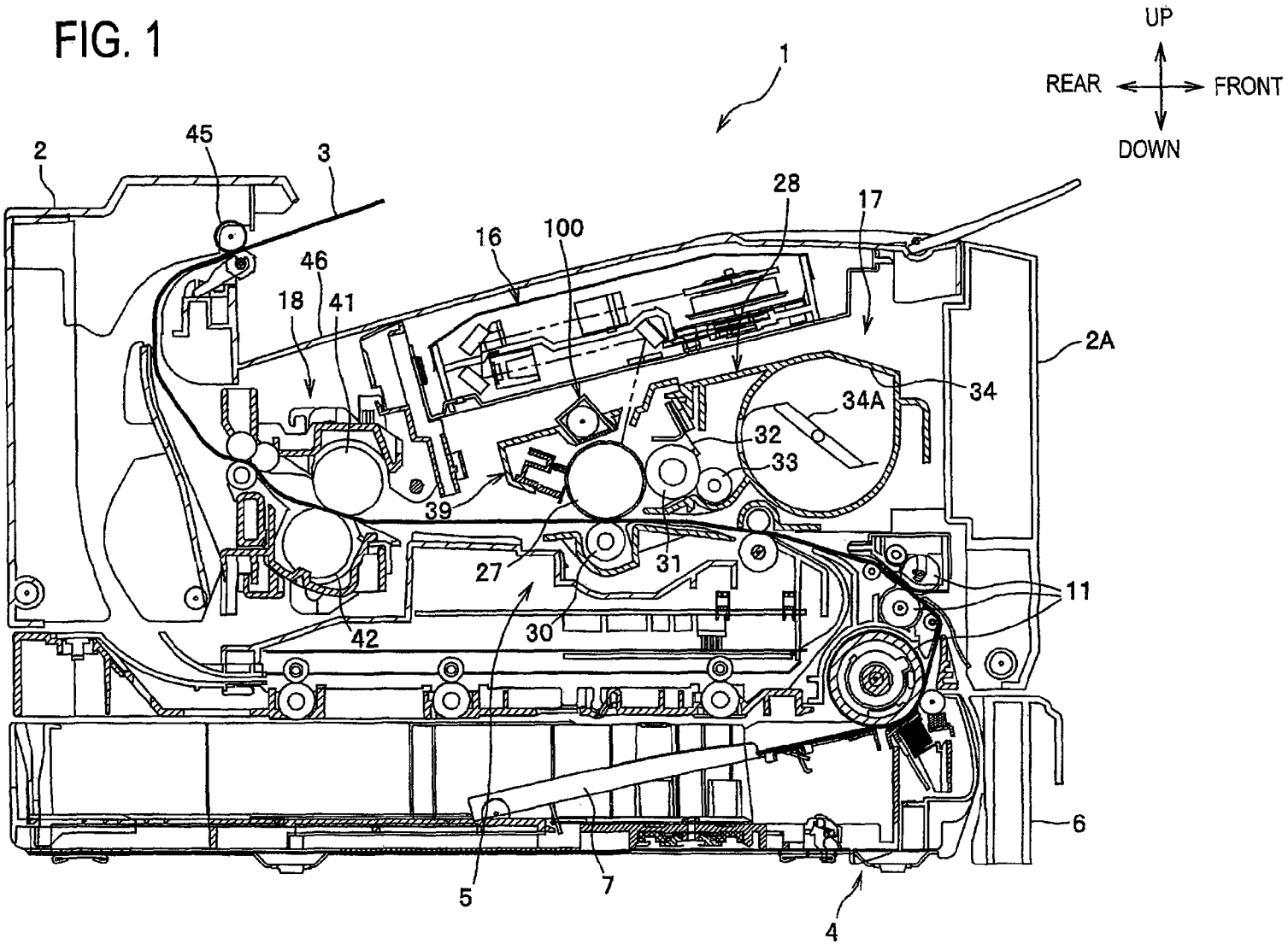
FIG. 1 is a cross-sectional view illustrating a general configuration of an image forming apparatus according to an embodiment of the present invention, the image forming apparatus having a photosensitive drum and a charger.

First, a general configuration of a laser printer 1 according to an embodiment of the present invention will be described with reference to FIG. 1.

The laser printer 1 includes a main casing 2 within which a feeding unit 4 and an image forming unit 5 are provided. The main casing 2 is provided with a front cover 2A at a front side thereof. The main casing 2 has an upper surface on which a discharge tray 46 is formed, as shown in FIG. 1.

The feeding unit 4 supplies sheets 3 to the image forming unit 5. The feeding unit 4 includes a sheet tray 6, a lifting plate 7 and a variety of rollers 11. The sheet tray 6 is detachably mounted in a bottom portion of the main casing 2 and accommodates the sheets 3. The lifting plate 7 is disposed within the sheet tray 6 and urges the sheets 3 upward. The variety of rollers 11 include rollers that convey the sheets 3 and other rollers that remove paper dust from the sheets 3.

The image forming unit 5 includes a scanner unit 16, a process cartridge 17 and a fixing unit 18.

The process cartridge 17 is detachably mountable in the main casing 2 when the front cover 2A is opened. The process cartridge 17 includes a developing cartridge 28 and a drum unit 39.

The developing cartridge 28 is detachably mountable on the main casing 2 when installed on the drum unit 39. The developing cartridge 28 includes a developing roller 31, a thickness-regulating blade 32, a supply roller 33 and a toner accommodating chamber 34. Within the toner accommodating chamber 34, an agitator 34A is provided.

In the developing cartridge 28, toner accommodated in the toner accommodating chamber 34 is agitated by the agitator 34A and is then supplied to the developing roller 31 by the supply roller 33. At this time, the toner is positively tribocharged between the developing roller 31 and the supply roller 33. In accordance with rotation of the developing roller 31, the toner enters between the developing roller 31 and the thickness-regulating blade 32, being carried on the surface of the developing roller 31 as a thin layer of uniform thickness while being further tribocharged.

The drum unit 39 includes a photosensitive drum 27, a Scorotron charger 100 and a transfer roller 30. The photosensitive drum 27 is rotatable about its rotational axis 270 (See FIG. 2). The photosensitive drum 27 has a photosensitive surface 27A (See FIG. 2) on which a high-speed laser beam emitted from the scanner unit 16 is irradiated. The photosensitive drum 27 is electrically grounded. The charger 100 charges the photosensitive surface 27A of the photosensitive drum 27 uniformly with a positive polarity. After being charged by the charger 100, the photosensitive surface 27A is exposed by the laser beam. The exposed portions on the photosensitive surface 27A have therefore a lower potential, thereby forming a latent electrostatic image on the photosensitive surface 27A based on image data.

Subsequently, in accordance with rotation of the developing roller 31, the toner borne on the surface of the developing roller 31 is supplied to the latent electrostatic image formed on the surface of the photosensitive drum 27. In this way, the latent electrostatic image is made into a visible toner image. When the sheet 3 is conveyed and nipped between the photosensitive drum 27 and the transfer roller 30, the toner image formed on the surface of the photosensitive drum 27 is transferred onto the sheet 3.

The fixing unit 18 includes a heat roller 41 and a pressure roller 42. The heat roller 41 and the pressure roller 42 are disposed in opposition to each other so as to nip the sheet 3 therebetween. When the sheet 3 passes between the heat roller 41 and the pressure roller 42, the toner image transferred on the sheet 3 is thermally fixed on the sheet 3. The sheet 3 is then conveyed to discharge rollers 45 which are disposed downstream of the fixing unit 18 in sheet conveying direction. The sheet 3 is finally discharged from the main casing 2 onto the discharge tray 46.

Figure 2:
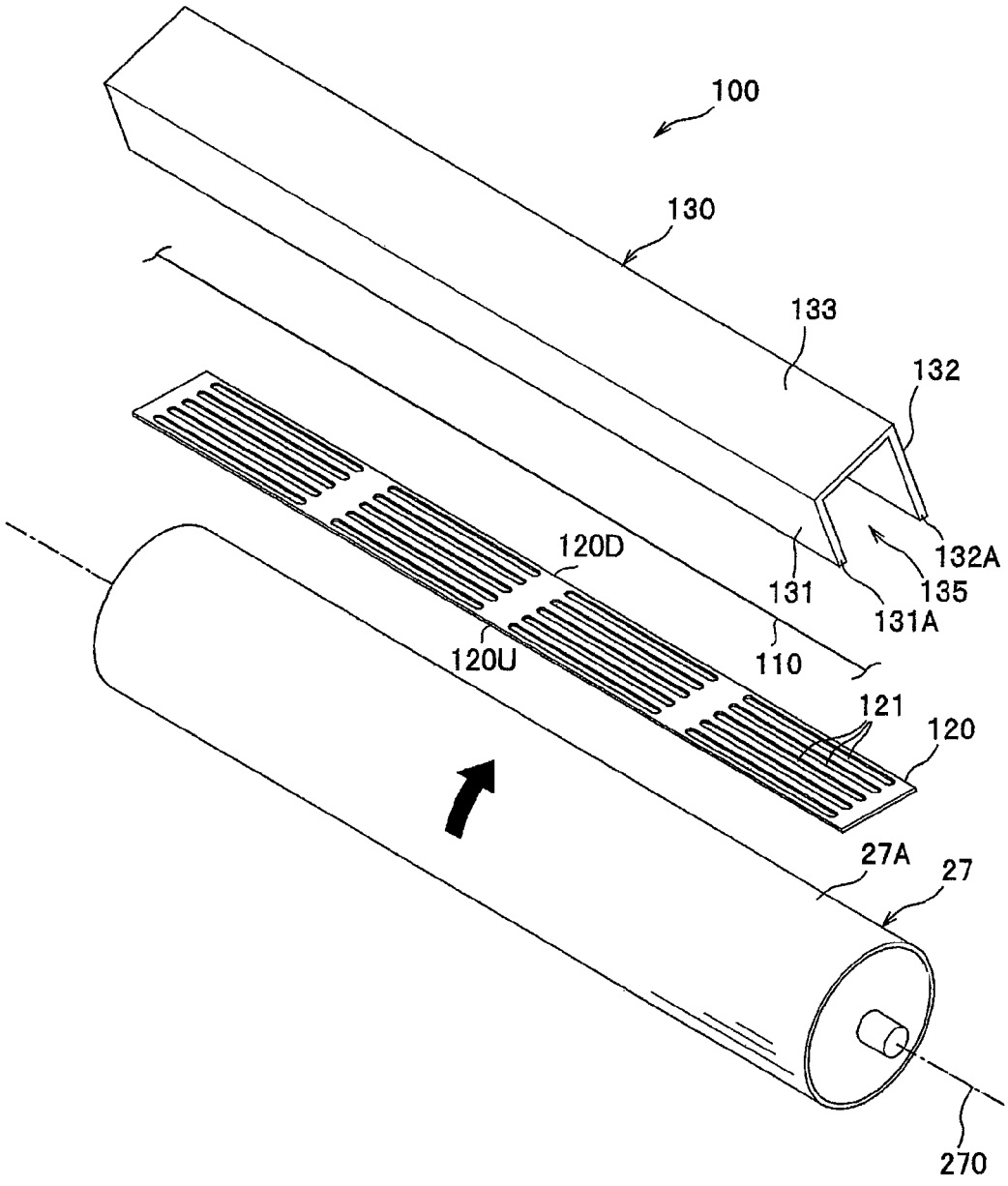
FIG. 2 is a perspective view showing the photosensitive drum and the charger, the charger being disassembled.
Figure 3:
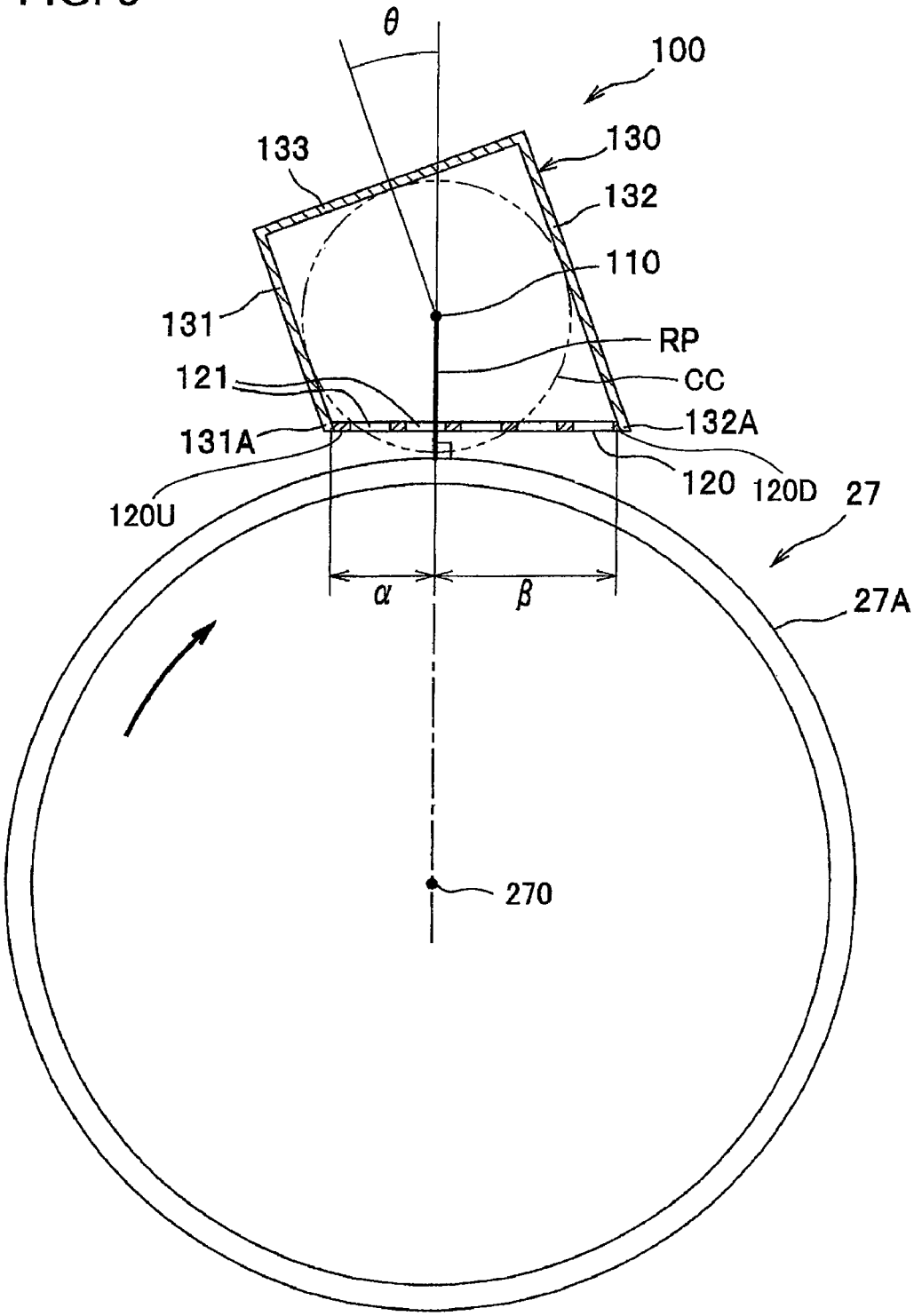
FIG. 3 is a schematic view illustrating the positional relationship between the charger and the photosensitive drum along a plane perpendicular to a rotational axis of the photosensitive drum and showing a cross-section of the charger taken along the plane.

Next, a detailed configuration of the charger 100 will be described with reference to FIGS. 2 and 3. FIG. 3 illustrates the positional relationship between the charger 100 and the photosensitive drum 27 along a plane perpendicular to the rotational axis 270 of the photosensitive drum 27, and shows the cross-section of the charger 100 taken along the plane. In FIGS. 2 and 3, the photosensitive surface 27A is assumed to move in a direction shown by a thick arrow. Hereinafter, this direction in which the photosensitive drum 27 moves will be referred to as the "moving direction."

As shown in FIG. 2, the charger 100 includes a wire electrode 110, a grid electrode 120 and a shield electrode 130.

The wire electrode 110 is disposed on a casing (not shown in FIG. 2) of the drum unit 39 so as to extend in a direction parallel to the rotational axis 270 of the photosensitive drum 27. The wire electrode 110 is applied with a voltage for generating corona discharge between the wire electrode 110 and the grid electrode 120 and the shield electrode 130. Here, referring to FIG. 3, a reference plane RP is defined as an imaginary plane that includes both of the wire electrode 110 and the rotational axis 270 of the photosensitive drum 27. The reference plane RP is therefore perpendicular to the photosensitive surface 27A.

The grid electrode 120 is a metallic member disposed between the wire electrode 110 and the photosensitive surface 27A of the photosensitive drum 27. The grid electrode 120 has an upstream end 120U and a downstream end 120D as shown in FIG. 2. The upstream end 120U is located upstream relative to the downstream end 120D in the moving direction of the photosensitive surface 27A as shown in FIG. 3. The grid electrode 120 is formed with a plurality of through-holes 121. The plurality of through-holes 121 is arranged on the grid electrode 120 such that the grid electrode 120 has a mesh shape. The shape and arrangement of the through-holes 121 do not necessarily have specific patterns. However, as shown in FIG. 3, one through-hole 121 is preferably positioned such that the reference plane RP passes through the through-hole 121. More preferably, the one through-hole 121 should be arranged such that the reference plane RP passes the center of the through-hole 121 in the moving direction. With this configuration, electric charges orienting from the wire electrode 110 toward the photosensitive surface 27A can reach the photosensitive surface 27A easily without being blocked by the grid electrode 120.

The shield electrode 130 is made of a metal material having a substantially U-shaped cross section. The shield electrode 130 covers the wire electrode 110 from a side opposite to the grid electrode 120. The shield electrode 130 includes a first wall section 131, a second wall section 132 and a third wall section 133, as shown in FIG. 2. The first wall section 131 is disposed upstream of the wire electrode 110 in the moving direction of the photosensitive surface 27A (i.e., left side in FIGS. 2 and 3), extending toward the grid electrode 120. The second wall section 132 is disposed in opposition to the first wall section 131 and at a position downstream of the wire electrode 110 in the moving direction of the photosensitive surface 27A (i.e., right side in FIGS. 2 and 3). The third wall section 133 is disposed in opposition to the grid electrode 120 and connects the first wall section 131 and the second wall section 132. The first wall section 131 has a first end 131A facing the photosensitive surface 27A, while the second wall section 132 has a second end 132A facing the photosensitive surface 27A.

The shield electrode 130 is formed with an opening 135 that faces the photosensitive surface 27A, as shown in FIG. 2. In other words, the opening 135 is defined by the first end 131A of the first wall section 131 and the second end 132A of the second wall section 132. The grid electrode 120 covers the opening 135. More specifically, the upstream end 120U of the grid electrode 120 is connected to the first end 131A of the first wall section 131, and the downstream end 120D of the grid electrode 120 is connected to the second end 132A of the second wall section 132.

The first wall section 131, the second wall section 132 and the third wall section 133 all are arranged so as to keep a distance substantially identical to each other from the wire electrode 110. Note that, the distance from the wire electrode 110 to each of the first wall section 131, second wall section 132 and third wall section 133 may be different from one another within an acceptable range of error. Here, the distance between each wall section and the wire electrode 110 is defined as a shortest distance from the wire electrode 110 to each of the wall sections, i.e., a length of an imaginary line segment that is drawn from the wire electrode 110 and is perpendicular to an imaginary plane that extends along the respective wall section. In this example, all of the wall sections 131-133 serve as tangent planes for a single imaginary circular cylinder CC whose central axis is positioned in coincidence with the wire electrode 110, as shown in FIG. 3. The first wall section 131 and the second wall section 132 are in parallel with each other, while the third wall section 133 is arranged to be orthogonal to both of the first wall section 131 and the second wall section 132.

The first wall section 131 is slanted relative to the reference plane RP such that, as the first wall section 131 extends closer to the photosensitive surface 27A, the first wall section 131 approaches the reference plane RP. In the present embodiment, an angle $\theta$ that is formed between the first wall section 131 and the reference plane RP is determined to be equal to twenty degrees (20°). This angle should preferably range from one to sixty degrees (1-60°), more preferably from five to forty-five degrees (5-45°).

Here, suppose that a distance $\alpha$ is defined as a distance between the first end 131A and the reference plane RP, while a distance $\beta$ is defined as a distance between the second end 132A and the reference plane RP. In other words, the distance $\alpha$ is defined as a length of a line segment that is drawn from the first end 131A perpendicularly to the reference plane RP, while the distance $\beta$ is defined as a length of a line segment that is drawn from the second end 132A perpendicularly to the reference plane RP. As described above, the first wall section 131 is arranged to slope relative to the reference plane RP such that the first wall section 131 approaches the reference plane RP as extending closer to the photosensitive surface 27A and that the distance $\alpha$ is smaller than the distance $\beta$.

The grid electrode 120 and the shield electrode 130 are applied with a potential different from the potential applied to the wire electrode 110. In the present embodiment, zero volt (ground voltage) is applied to the grid electrode 120 and the shield electrode 130. The photosensitive drum 27 is applied with zero volt.

Next, technical effects of the charger 100 having the above-identified configuration will be described with reference to FIG. 3.

The photosensitive drum 27 rotates in a clockwise direction in FIG. 3 to move the photosensitive surface 27A in the moving direction, as indicated by the thick arrow. When a prescribed voltage is applied to the wire electrode 110, an electric field is generated in a substantially concentric manner about the wire electrode 110, spreading from the wire electrode 110 to the grid electrode 120 and the shield electrode 130. In this way, corona discharge is generated. Electric charges generated from the wire electrode 110 pass through the through-holes 121 and reach the photosensitive surface 27A, thereby charging the photosensitive surface 27A of the photosensitive drum 27.

The concentric electric field is generated about the wire electrode 110 due to the voltage applied thereto. Therefore, on the photosensitive surface 27A, current density is highest at a position closest to the wire electrode 110 in FIG. 3 (a position where the reference plane RP intersects with the photosensitive surface 27A). As leaving farther away from this position, current densities on the photosensitive surface 27A become lower with respect to the reference plane RP.

In the present embodiment, the distance α is set to be smaller than the distance β. This means that the reference plane RP is positioned relatively upstream within the opening 135 of the shield electrode 130 in the moving direction, which in turn means that the wire electrode 110 is located relatively upstream within the opening 135 in the moving direction. Hence, as soon as the photosensitive surface 27A of the rotating photosensitive drum 27 faces the opening 135 of the shield electrode 130, the photosensitive surface 27A is exposed to relatively high current densities within the opening 135, receiving significant current flows thereonto. As a result, the photosensitive surface 27A can be efficiently charged with a relatively large amount of charges at the time when the photosensitive surface 27A starts facing the opening 135, thereby facilitating rise in the potential on the photosensitive surface 27A. Therefore, the photosensitive surface 27A can be sufficiently charged to reach a sufficiently high potential even if the photosensitive surface 27A has faced the opening 135 for a short period of time. In other words, with the above-described configuration, the charger 100 can efficiently charge the photosensitive drum 27.

Further, since the distances (shortest distances) from the wire electrode 110 to the respective wall sections 131, 132 and 133 of the shield electrode 130 are substantially identical to one another, corona discharge can be stably generated in the charger 100 according to the present embodiment.

Although the present invention has been described in detail with reference to the embodiment thereof, the present invention is not limited to the above-described configuration.

For example, the angle θ formed between the first wall section 131 and the reference plane RP can be made larger than 20 degrees.

Figure 4:
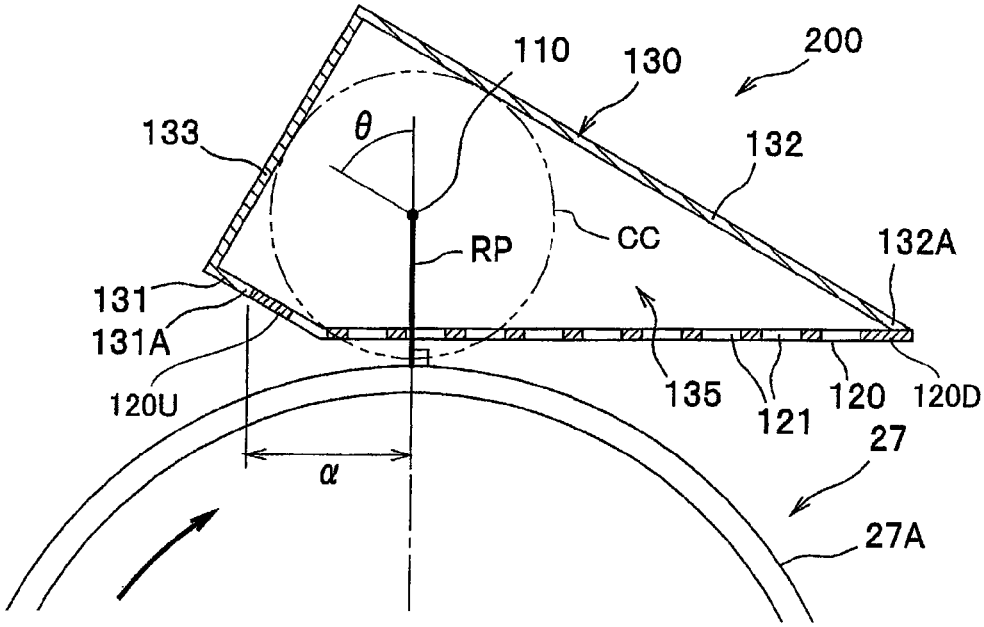
FIG. 4 is a cross-sectional view of a charger according to a first variation of the embodiment.

However, if the angle θ is made greater, there may arise a possibility that the distance α between the first end 131A and the reference plane RP will become too short. In order to solve this problem, as a first variation of the present embodiment, there is provided a charger 200 as shown in FIG. 4. In this variation, the angle θ is set to be about 60 degrees. The first wall section 131 is made shorter than in the embodiment. The grid electrode 120 is bent, at a position close to the upstream end 120U, in a direction toward the first wall section 131. The upstream end 120U of the grid electrode 120 is connected to the first end 131A of the first wall section 131. In this example, the second wall section 132, the third wall section 133 and an imaginary plane that extends along the first wall section 131 serve as tangent planes for the imaginary circular cylinder CC whose central axis is in coincidence with the wire electrode 110. This configuration ensures that the opening 135 of the shield electrode 130 can have a sufficiently large amount of area opposing the photosensitive surface 27A.

Figure 5:
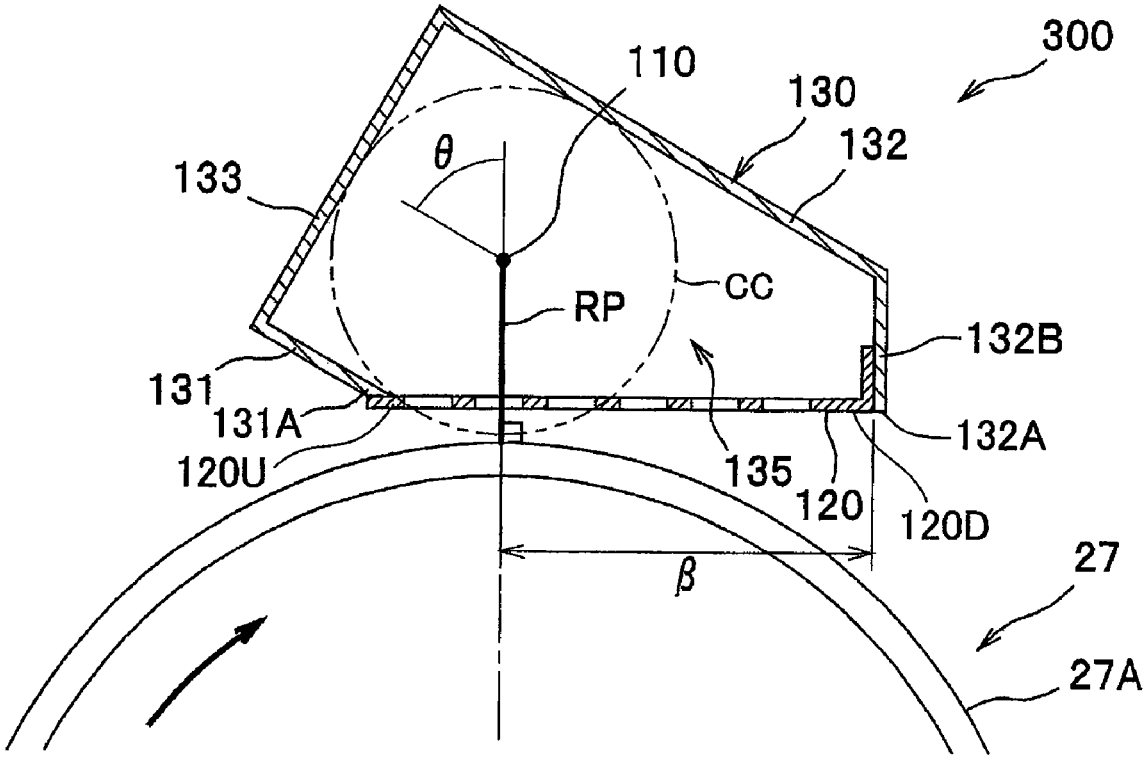
FIG. 5 is a cross-sectional view of a charger according to a second variation of the embodiment.

Similarly, if the angle θ is relatively great, there may also arise a problem that the distance β between the second end 132A and the reference plane RP will be too large, leading to a larger charger in size. In order to solve this problem, as a second variation of the present embodiment, there is provided another charger 300 as shown in FIG. 5. In the charger 300, the second wall section 132 is bent, at a position close to the second end 132A, in a direction toward the grid electrode 120. A portion of the second wall section 132 that is bent toward the grid electrode 120 is referred to as "bent portion 132B" in FIG. 5. In this example, a part of the bent portion 132B including the second end 132A is connected to the downstream end 120D of the grid electrode 120. The bent portion 132B ensures that the opening 135 of the shield electrode 130 and the photosensitive surface 27A can reliably face each other, while the charger 300 can be made compact.

Figure 6:
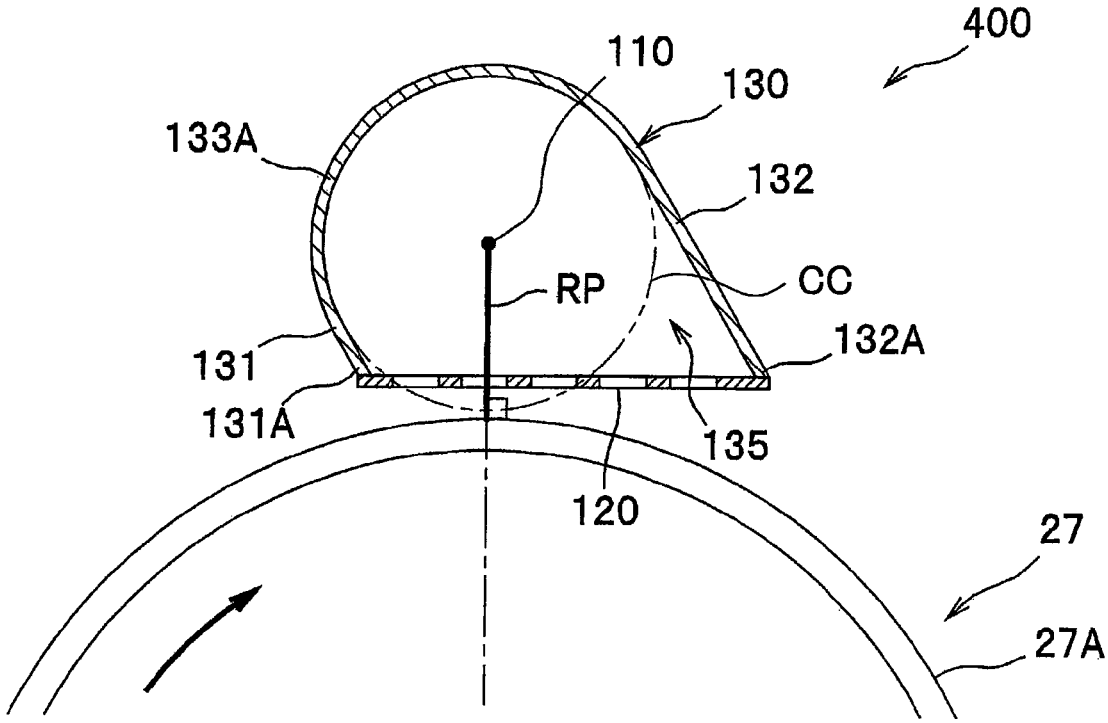
FIG. 6 is a cross-sectional view of a charger according to a bird variation of the embodiment.

As a third variation of the present embodiment, FIG. 6 shows a charger 400 in which a third wall section 133A (corresponding to the third wall section 133 in the embodiment) is formed to have a circular arc shaped cross-section taken along a plane perpendicular to the wire electrode 110. In this example, the first wall section 131 and the second wall section 132 serve as tangent planes for the imaginary circular cylinder CC whose central axis coincides with the wire electrode 110, and the third wall section 133A serves as a part of the peripheral surface of the imaginary circular cylinder CC.

Figure 7:
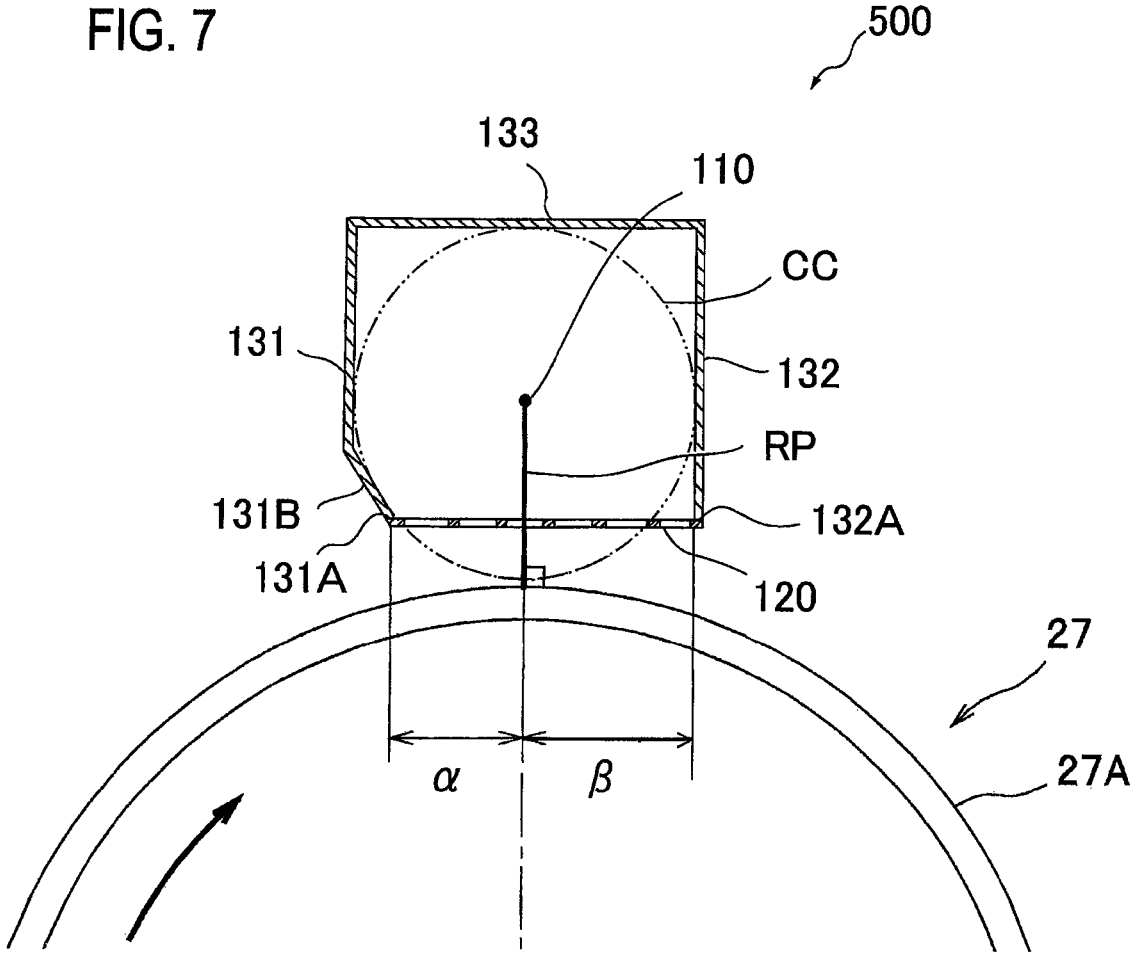
FIG. 7 is a cross-sectional view of a charger according to a further variation of the present embodiment.

In the present embodiment, the first wall section 131 of the shield electrode 130 is slanted relative to the reference plane RP. However, the first wall section 131 may be arranged to extend partially in parallel to the reference plane RP. FIG. 7 shows a charger 500 according to a further variation of the embodiment. In this variation, the first wall section 131 extends from its one end that is connected to the third wall section 133 in a direction toward the photosensitive surface 27A in parallel to the reference plane RP, and is then bent at a position near to the first end 131A in a direction toward the reference plane RP so that the opening 135 can be narrowed down. A portion of the first wall section 131 that is bent toward the reference plane RP is referred to as "bent portion 131B" in FIG. 7. Still in this case, all of the wall sections 131-133 including the bent portion 131B are equidistant from the wire electrode 110 and serve as tangent planes for the imaginary circular cylinder CC. With this configuration as well, the bent portion 131B of the first wall section 131 slopes relative to the reference plane RP such that the bent portion 131B approaches the reference plane RP as extending closer to the photosensitive surface 27A, thereby realizing the relationship that the distance α is shorter than the distance β. Hence, this configuration also allows a rapid rise in potential on the photosensitive surface 27A.

Next, a computational experiment executed for confirming the technical effects of the present embodiment will be described with reference to FIGS. 8A through 9.

Figure 8A:
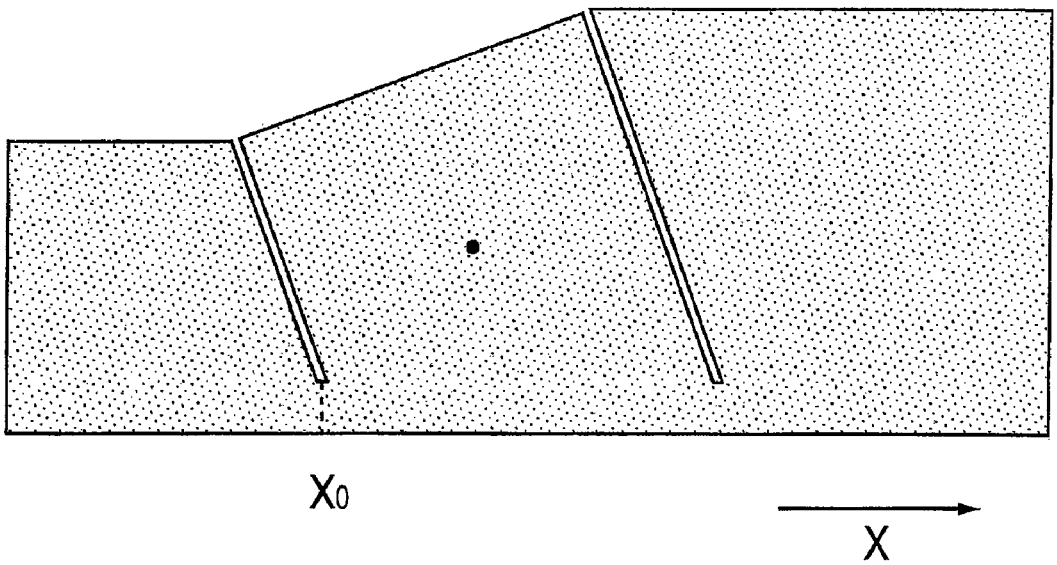
FIG. 8A is a computer-generated two-dimensional simulation model representing the embodiment of the present invention, in which X representing a position on the photosensitive drum along the direction in which the surface of the photosensitive drum moves.
Figure 8B:
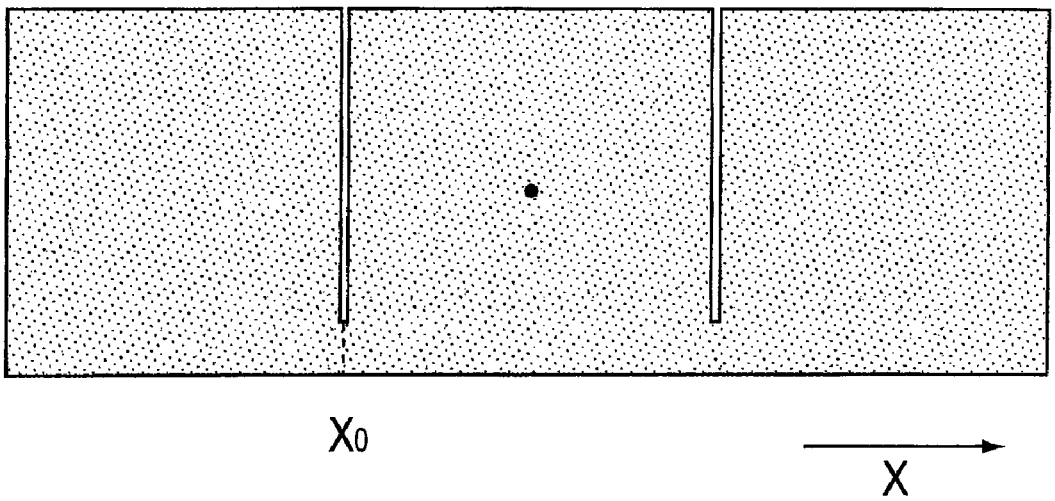
FIG. 8B is a computer-generated two-dimensional simulation model of a comparative example, in which X representing a position on the surface of the photosensitive drum.

In FIGS. 8A and 8B, simulated spaces representing the spaces in and around the charger 100 of the present embodiment and those of a charger in the comparative example are shown as hatched regions. Bottom lines of each model are assumed to be the photosensitive surface 27A. A position X is defined in a horizontal direction as a position along the photosensitive surface 27A in the moving direction. In FIGS. 8A through 10, a reference position is defined as a position $X_0$ on the photosensitive surface 27A where the first end 131A of the first wall section 131 opposes the photosensitive surface 27A.

Assuming that five kilovolts is applied to portions corresponding to the wire electrode 110, and 0 kilovolts is applied to the outlines corresponding to the shield electrode 130 and the photosensitive surface 27A in the above-described spaces of each model, distribution of current density is calculated in association with the position X on the photosensitive surface 27A for each model.

Figure 9:
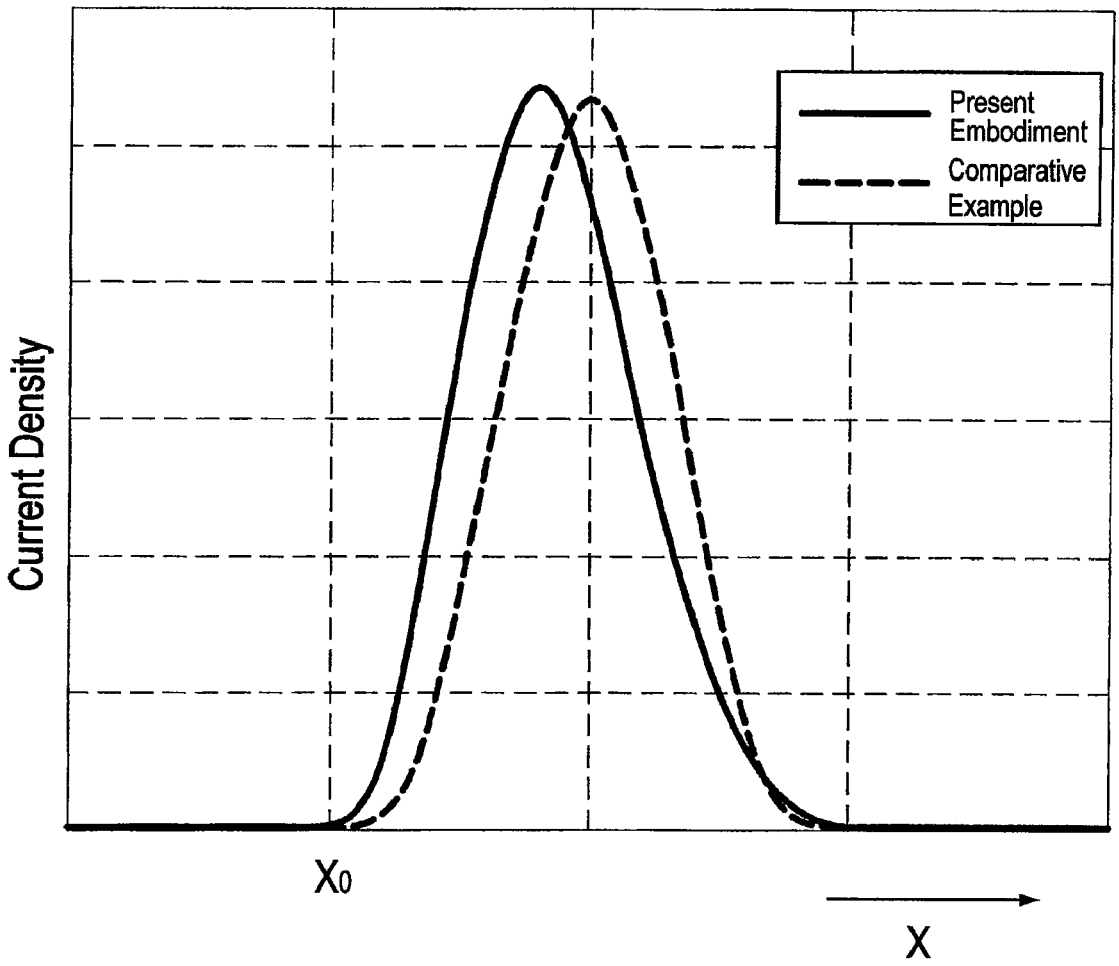
FIG. 9 is a graph showing relationships between the position X and current density obtained as a result of the simulation.

A graph in FIG. 9 shows relationships between the current density and the position X for the respective models obtained as a result of the calculations. As shown in FIG. 9, according to the charger 100 of the present embodiment which is indicated by a solid line, the current density starts to rise rapidly from a position whose X coordinate value is smaller and which is closer to the reference position $X_0$, compared to the comparative example. This simulation has demonstrated that the current density of the present embodiment reaches a peak thereof at a position whose X coordinate value is smaller and which is nearer to the reference position $X_0$ than that of the comparative example.

Subsequently, charged potentials on the photosensitive surfaces of both examples are estimated for each position X by accumulating the current densities from the position where X is the smallest to each X position, based on the relationships between the current density and the position X shown in FIG. 9.

Figure 10:
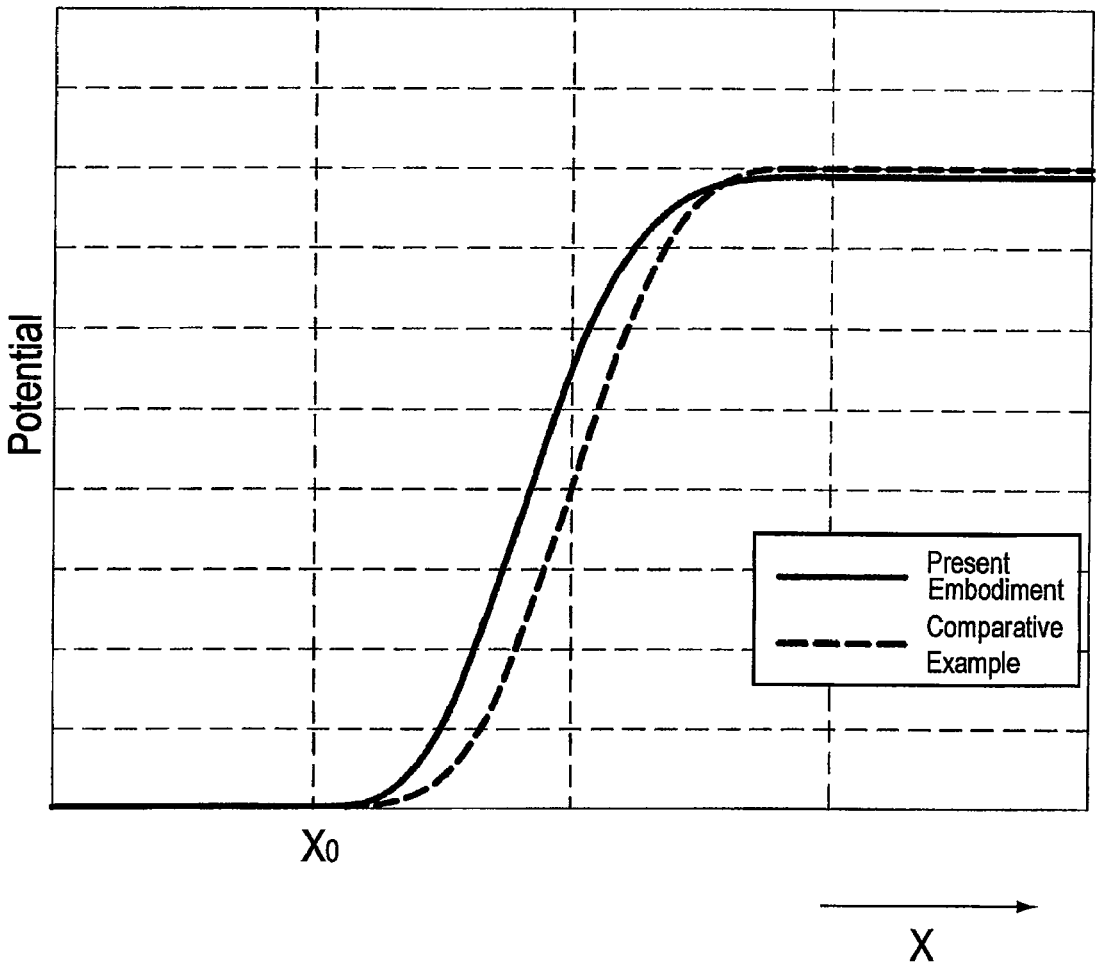
FIG. 10 is a graph showing estimated charged potentials of the surface of the photosensitive drum in correspondence with the position X obtained as a result of the simulation.

As FIG. 10 shows, the photosensitive surface of the present embodiment reaches a sufficiently high potential at a position whose X coordinate value is smaller compared to the comparative example.

As demonstrated above, the charger according to the present embodiment can realize a prompt increase in the current density, leading to high potentials on the photosensitive surface at a position facing the charger, while maintaining stable charging characteristics because the wire electrode is substantially equally distanced from respective portions of the shield electrode.

While the present invention has been described in detail with reference to the specific embodiment thereof, it would be apparent to those skilled in the art that various changes and modifications may be made therein without departing from the spirit of the invention.

For instance, instead of the drum-shaped photosensitive drum 27 of the embodiment, a belt-shaped photosensitive member may be employed.

Further, although the present invention is applied to the laser printer 1 in the embodiment, the present invention may also be applicable to other types of image forming devices, such as a copier, multifunctional peripheral, color LED printer and the like.

What is claimed is:

1. An image forming device comprising:

a photosensitive member having a photosensitive surface that moves in a moving direction and that is configured to form a latent electrostatic image thereon; and a charger that opposes the photosensitive surface and that is configured to charge the photosensitive surface, the charger including:

a wire electrode that is configured to be applied with a voltage for charging the photosensitive surface;

a grid electrode that is disposed at a location between the wire electrode and the photosensitive surface; and a shield electrode that is arranged to partly surround the wire electrode, the shield electrode having a plurality of sections, the shield electrode having an opening at a side the same as the grid electrode with respect to the wire electrode, the shield electrode including a first end and a second end each facing the photosensitive surface, the first end being disposed upstream relative to the second end in the moving direction, the opening being defined between the first end and the second end, a shortest distance being defined between each of the plurality of sections of the shield electrode and the wire electrode and being a length of a straight line that connects the wire electrode and an imaginary plane extending along the each section and that is perpendicular to the imaginary plane, the shortest distances between the respective sections of the shield electrode and the wire electrode being equal to one another, a first distance defined between the first end and a reference plane being smaller than a second distance defined between the second end and the reference plane, the reference plane including the wire electrode and extending perpendicularly to the photosensitive surface.

2. The image forming device according to claim 1, wherein the plurality of sections of the shield electrode includes a first wall, a second wall and a third wall, the first wall having a first portion that includes the first end, the second wall having a second portion that includes the second end, the third wall being disposed in opposition to the grid electrode, the first wall extending from the third wall toward the grid electrode, the first wall being disposed upstream of the wire electrode in the moving direction, the second wall being in opposition to the first wall, at least the second portion being disposed downstream of the wire electrode in the moving direction, at least the first portion of the first wall sloping relative to the reference plane such that the at least the first portion approaches the reference plane as the at least the first portion extends closer to the photosensitive surface.

3. The image forming device according to claim 2, wherein the grid electrode has an upstream end and a downstream end, the upstream end being located upstream relative to the downstream end in the moving direction, the upstream end being connected to the first end, the downstream end being connected to the second end.

4. The image forming device according to claim 3, wherein the grid electrode is bent toward the first end at a position close to the upstream end.

5. The image forming device according to claim 3, wherein the second wall is bent toward the downstream end of the grid electrode at a position close to the second end.

6. The image forming device according to claim 3, wherein the third wall is formed to have a circular arc shaped cross-section.

7. A drum unit that is detachably mounted in an image forming device, the drum unit comprising:

a photosensitive member having a photosensitive surface that moves in a moving direction and that is configured to form a latent electrostatic image thereon; and a charger that is disposed in opposition to the photosensitive surface and that is configured to charge the photosensitive surface, the charger including:

a wire electrode that is configured to be applied with a voltage for charging the photosensitive surface;

a grid electrode that is disposed at a location between the wire electrode and the photosensitive surface; and a shield electrode that is arranged to partly surround the wire electrode, the shield electrode having a plurality of sections, the shield electrode having an opening at a side the same as the grid electrode with respect to the wire electrode, the shield electrode including a first end and a second end each facing the photosensitive surface, the first end being disposed upstream relative to the second end in the moving direction, the opening being defined between the first end and the second end, a shortest distance being defined between each of the plurality of sections of the shield electrode and the wire electrode and being a length of a straight line that connects the wire electrode and an imaginary plane extending along the each section and that is perpendicular to the imaginary plane, the shortest distances between the respective sections of the shield electrode and the wire electrode being equal to one another, a first distance defined between the first end and a reference plane being smaller than a second distance defined between the second end and the reference plane, the reference plane including the wire electrode and extending perpendicularly to the photosensitive surface.

8. The drum unit according to claim 7, wherein the plurality of sections of the shield electrode includes a first wall, a second wall and a third wall, the first wall having a first portion that includes the first end, the second wall having a second portion that includes the second end, the third wall being disposed in opposition to the grid electrode, the first wall extending from the third wall toward the grid electrode, the first wall being disposed upstream of the wire electrode in the moving direction, the second wall being in opposition to the first wall, at least the second portion being disposed downstream of the wire electrode in the moving direction, at least the first portion of the first wall sloping relative to the reference plane such that the at least the first portion approaches the reference plane as the at least the first portion extends closer to the photosensitive surface.

9. The drum unit according to claim 8, wherein the grid electrode has an upstream end and a downstream end, the upstream end being located upstream relative to the downstream end in the moving direction, the upstream end being connected to the first end, the downstream end being connected to the second end.

10. The drum unit according to claim 9, wherein the grid electrode is bent toward the first end at a position close to the upstream end.

11. The drum unit according to claim 9, wherein the second wall is bent toward the downstream end of the grid electrode at a position close to the second end.

12. The drum unit according to claim 9, wherein the third wall is formed to have a circular arc shaped cross-section.

13. A charger disposed in an image forming device, the image forming device being provided with a photosensitive member having a photosensitive surface that moves in a moving direction and that is configured to form a latent electrostatic image thereon, the charger opposing the photosensitive surface and being configured to charge the photosensitive surface, the charger comprising:

a wire electrode that is configured to be applied with a voltage and to charge the photosensitive surface;

a grid electrode that is disposed at a location between the wire electrode and the photosensitive surface; and a shield electrode that is arranged to partly surround the wire electrode, the shield electrode having a plurality of sections, the shield electrode having an opening at a side the same as the grid electrode with respect to the wire electrode, the shield electrode including a first end and a second end each facing the photosensitive surface, the first end being disposed upstream relative to the second end in the moving direction, the opening being defined between the first end and the second end, a shortest distance being defined between each of the plurality of sections of the shield electrode and the wire electrode and being a length of a straight line that connects the wire electrode and an imaginary plane extending along the each section and that is perpendicular to the imaginary plane, the shortest distances between the respective sections of the shield electrode and the wire electrode being equal to one another, a first distance defined between the first end and a reference plane being smaller than a second distance defined between the second end and the reference plane, the reference plane including the wire electrode and extending perpendicularly to the photosensitive surface.

14. The charger according to claim 13, wherein the plurality of sections of the shield electrode includes a first wall, a second wall and a third wall, the first wall having a first portion that includes the first end, the second wall having a second portion that includes the second end, the third wall being disposed in opposition to the grid electrode, the first wall extending from the third wall toward the grid electrode, the first wall being disposed upstream of the wire electrode in the moving direction, the second wall being in opposition to the first wall, at least the second portion being disposed downstream of the wire electrode in the moving direction, at least the first portion of the first wall sloping relative to the reference plane such that the at least the first portion approaches the reference plane as the at least the first portion extends closer to the photosensitive surface.

15. The charger according to claim 14, wherein the grid electrode has an upstream end and a downstream end, the upstream end being located upstream relative to the downstream end in the moving direction, the upstream end being connected to the first end, the downstream end being connected to the second end.

16. The charger according to claim 15, wherein the grid electrode is bent toward the first end at a position close to the upstream end.

17. The charger according to claim 15, wherein the second wall is bent toward the downstream end of the grid electrode at a position close to the second end.

18. The charger according to claim 15, wherein the third wall is formed to have a circular arc shaped cross-section.

* * * * *